US007025415B1

(12) United States Patent
Wu

(10) Patent No.: US 7,025,415 B1
(45) Date of Patent: Apr. 11, 2006

(54) MULTIFUNCTIONAL CHAIR

(76) Inventor: Chieh-Ming Wu, No. 6, Lane 4-30, Chuan-Chou Rd., Hou-Li Hsiang, Taichung Hsien (TW)

( * ) Notice: Subject to any disclaimer, the term of this patent is extended or adjusted under 35 U.S.C. 154(b) by 0 days.

(21) Appl. No.: 10/969,045

(22) Filed: Oct. 21, 2004

(30) Foreign Application Priority Data

Aug. 3, 2004 (TW) ..... 93212305 U

(51) Int. Cl.

| | |
|---|---|
| ***A47C 1/032*** | (2006.01) |
| ***A47C 1/035*** | (2006.01) |
| ***A47B 85/04*** | (2006.01) |
| ***A63B 21/00*** | (2006.01) |
| ***A63B 26/00*** | (2006.01) |

(52) U.S. Cl. ..... 297/119; 297/68; 297/83; 297/84; 297/122; 297/129; 297/316; 297/325; 297/330; 482/138; 482/142

(58) Field of Classification Search ..... 297/119, 297/68, 69, 83, 84, 88, 122, 123, 124, 129, 297/316, 325, 330, 354.11; 482/138, 142
See application file for complete search history.

(56) References Cited

U.S. PATENT DOCUMENTS

| | | | | | |
|---|---|---|---|---|---|
| 121,941 | A | * | 12/1871 | Hastings | 297/83 |
| 377,011 | A | * | 1/1888 | Berger | 297/83 |
| 377,806 | A | * | 2/1888 | Grave | 297/119 |
| 655,593 | A | * | 8/1900 | Webb | 297/129 |
| 1,320,365 | A | * | 10/1919 | Clough | 297/119 X |
| 1,937,056 | A | * | 11/1933 | Cuthell | 297/83 |
| 1,937,886 | A | * | 12/1933 | Grose | 297/122 X |
| 2,377,649 | A | * | 6/1945 | Quinney | 297/68 |
| 2,416,410 | A | * | 2/1947 | Shampaine | 297/330 X |
| 2,564,083 | A | * | 8/1951 | Stechert | 297/83 X |
| 2,753,920 | A | * | 7/1956 | Ranger | 297/83 |
| 2,786,512 | A | * | 3/1957 | Moyer | 297/122 |
| 2,888,062 | A | * | 5/1959 | Lockwood | 297/122 |
| 3,050,741 | A | * | 8/1962 | Coleman | 297/122 X |
| 3,191,196 | A | * | 6/1965 | Holm | 297/330 X |
| 3,261,639 | A | * | 7/1966 | Phillips | 297/83 |
| 3,495,869 | A | * | 2/1970 | Ingemansson | 297/330 X |
| 3,589,715 | A | * | 6/1971 | Mark et al. | 297/316 X |
| 3,641,995 | A | * | 2/1972 | Brandt | 297/330 X |
| 4,168,099 | A | * | 9/1979 | Jacobs et al. | 297/325 |

(Continued)

FOREIGN PATENT DOCUMENTS

| | | | | |
|---|---|---|---|---|
| DE | 3234836 A1 | * | 3/1984 | 297/68 |

(Continued)

*Primary Examiner*—Rodney B White
(74) *Attorney, Agent, or Firm*—Pillsbury Winthrop Shaw Pittman, LLP

(57) ABSTRACT

A multifunctional chair comprises a base adapted to rest on the ground; a support frame including a seat part and a backrest part pivotally attached to the seat part; a leg frame supporting the support frame and including a rear leg having a first end pivotally connected to the backrest part and a second end pivotally connected to the base; and a power-operated telescopic device including a telescopic member pivotally connected to the seat part and being operable to maintain the seat part at a level lower than said backrest in a normal position providing a chair function, or to move the seat part to a first raised position in which the seat part together with the backrest part are placed in a substantially horizontal position, or to a second raised position in which the seat part together with the backrest part are inclined at substantially the same inclining angle.

8 Claims, 9 Drawing Sheets

U.S. PATENT DOCUMENTS 4,634,127 A * 1/1987 Rockwell ..... 482/138
4,937,900 A * 7/1990 Bridges ..... 297/330 X
4,966,413 A * 10/1990 Palarski ..... 297/330
5,098,158 A * 3/1992 Palarski ..... 297/330
5,110,183 A * 5/1992 Jeanes, III ..... 297/325 X
5,127,705 A * 7/1992 Antoine et al. ..... 297/68
5,158,074 A * 10/1992 Grellas ..... 601/24
5,232,426 A * 8/1993 Van Straaten ..... 482/142 X
5,451,092 A * 9/1995 Gray ..... 297/122
5,462,510 A * 10/1995 Ish, III ..... 482/142
5,549,530 A * 8/1996 Fulks ..... 482/138 X
5,669,865 A * 9/1997 Gordon ..... 482/142
5,755,650 A * 5/1998 Urso ..... 482/138
5,790,997 A * 8/1998 Ruehl ..... 297/330 X
5,868,461 A * 2/1999 Brotherston ..... 297/84
5,902,220 A * 5/1999 Lin ..... 297/316 X
6,158,808 A * 12/2000 Margolis et al. ..... 297/330
6,689,027 B1 * 2/2004 Gardikis, Jr. ..... 482/142
2005/0121959 A1 * 6/2005 Kruse et al. ..... 297/330

FOREIGN PATENT DOCUMENTS

EP 177081 A2 * 4/1986 ..... 297/316
GB 2157557 A * 10/1985 ..... 297/330

* cited by examiner

MULTIFUNCTIONAL CHAIR

CROSS REFERENCE TO RELATED APPLICATION(S)

This application claims the priority of Taiwanese application No. 093212305 filed Aug. 3, 2004.

BACKGROUND OF THE INVENTION

1. Field of the Invention

The present invention relates to a chair, more particularly to a multifunctional chair which provides a number of uses or functions.

2. Description of the Related Art

People in this modern world cannot get as much exercise as necessary due usually to the confines of their environment. As such, there are various types of exercise or fitness equipment in the market available to users for indoor operation so as to achieve the effect of body exercise and health. However, such exercise or fitness equipment as inversion tables and back stretching machines for stretching the body should be of a considerable length because there has to be a flat surface for the body to lie down. Thus, the currently available exercise or fitness equipment usually provides only one use or function. There is no economic advantage at all for such exercise or fitness equipment which takes up space but has only few uses or functions.

The present invention is thus contrived in an attempt to alleviate the above shortcomings of the prior art.

SUMMARY OF THE INVENTION

Therefore, a main object of the present invention is to provide a multifunctional chair with increased use benefits as well as better economic results achieved.

Accordingly, the multifunctional chair according to the present invention comprises a base adapted to rest on the ground; a support frame including a seat part and a backrest part pivotally attached to the seat part in the normal position of the chair; a leg frame supporting the support frame and including a rear leg disposed between the backrest part and the base, the rear leg having a first end pivotally connected to the backrest part and a second end pivotally connected to the base; and a power-operated telescopic device disposed between the base and the support frame, the telescopic device including a telescopic member pivotally connected to the seat part, the telescopic member being operable to maintain the seat part at a level lower than said backrest in the normal position providing a chair function, or to move the seat part to a first raised position in which the seat part together with the backrest part are placed in a substantially horizontal position, or to a second raised position in which the seat part together with the backrest part are inclined at substantially the same inclining angle.

The multifunctional chair according to the present invention is capable of three configurations to provide three different functions. In the first normal chair configuration, a weight lifting device may be attached to the front end of the seat part so that a user may sit on the chair and perform some foot exercises. In the second configuration in which the seat part and the backrest part are placed in a substantially horizontal position, a flat surface is provided for a user to perform back stretching exercises or other suitable exercises. In the third configuration in which the seat part and the backrest part which are in the horizontal position are inclined at substantially the same inclining angle, the exercise function of an inversion table is provided.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
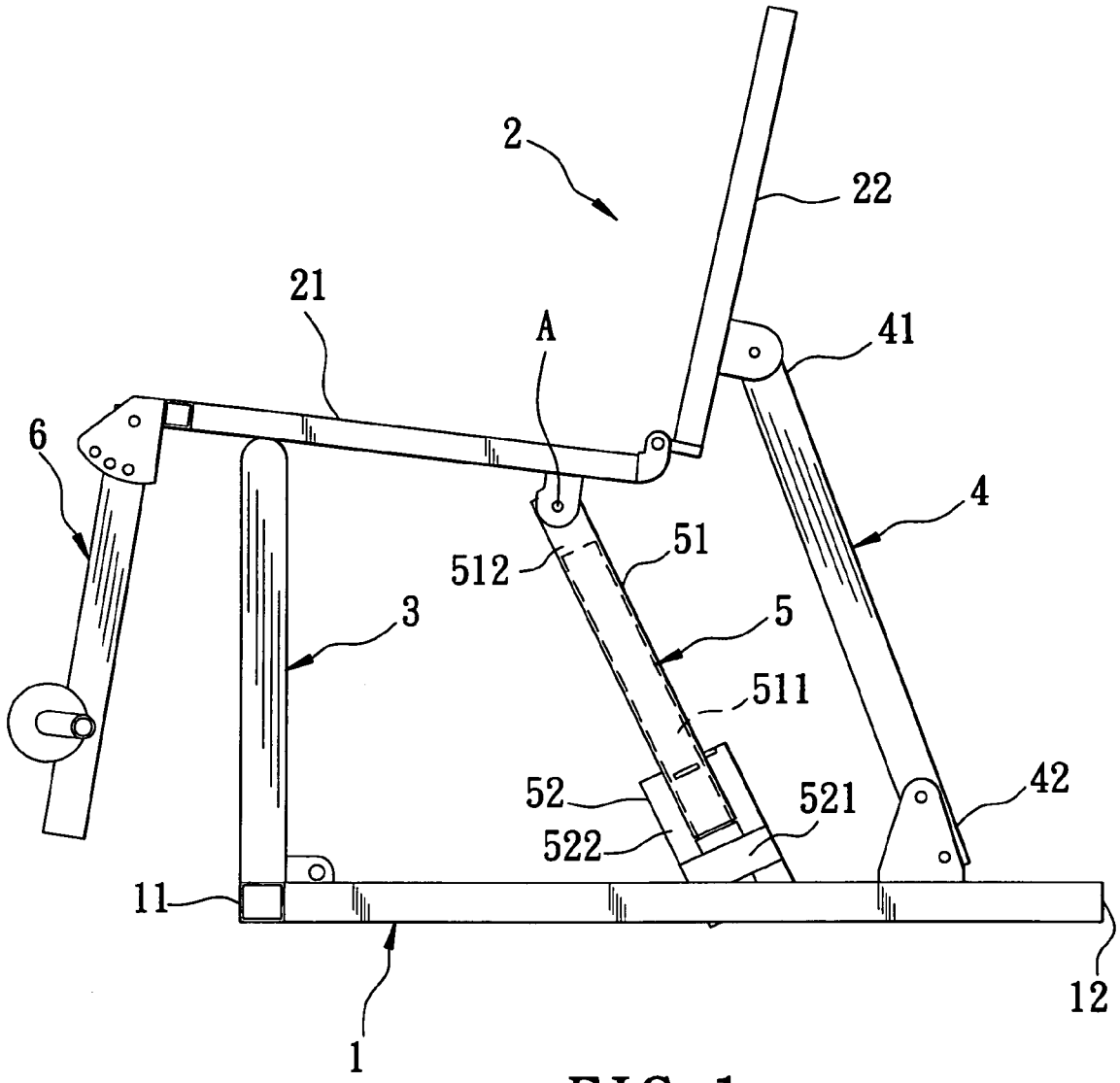
FIG. 1 is a side elevational view of a first preferred embodiment of the multifunctional chair according to the present invention.

The construction of the preferred embodiments of the multifunctional chair according to the present invention will now be described in greater detail in conjunction with the drawings where like reference numerals are used to identify like elements.

Referring to FIG. 1, a first preferred embodiment of the multifunctional chair according to the present invention as shown therein generally comprises a base 1 adapted to rest on the ground, a support fame 2, a leg fame supporting the support fame 2 onto the base 1, and a power-operated telescopic device 5 disposed between the base 1 and the support frame 2.

The base 1 extends in a horizontal direction and has opposing first end 11 and second end 12. The support frame 2 includes a seat part 21 and a backrest part 22 pivotally connected to a rear end of said seat part 21. The leg frame includes a front leg 3 disposed between the seat part 21 and the base 1 and attached to the base 1 at a position adjacent the first end 11 of the base 1, and a rear leg 4 disposed between the backrest part 22 and the base 1. The rear leg 4 has a first end 41 pivotally connected to the backrest part 22 and second end 42 pivotally connected to the base 1 at a position adjacent the second end 12 of the base 1.

The power-operated telescopic device 5 includes a telescopic member 51 pivotally connected to the seat part 21 at a position between the front leg 3 and the rear leg 4. The telescopic member 51 has an internally threaded outer cylinder 512 pivotally attached to the seat part 21, at the position denoted by the pivot connection "A" between the front and rear ends of the seat part 21 as shown in the drawing, and a rotatable externally threaded rod 511 inserted threadedly into the outer cylinder 512. The telescopic device 5 further includes drive means 52 for rotating the rod 511 to either extend from or retract into the outer cylinder 512. The drive means includes a gear box 521 mounted on the base 1, and a motor 522 connected to a gear mechanism (not shown) within the gear box 521, which in turn is connected to the threaded rod 511 to drive the rotation of the threaded rod 511.

The telescopic member 51 can be actuated by the drive means 52 to form three different configurations of the multifunctional chair to provide three different functions. In the normal position when the multifunctional chair provides a chair function as shown in FIG. 1, the telescopic member 51 is operated to maintain the seat part 21 at a level lower than the backrest part 22. In this normal chair configuration, the front leg 3 of the leg frame and the telescopic device 5, which is disposed between the front leg 3 and the rear leg 4, both support the seat part 21. It is possible, however, for the telescopic device 5 to provide such supportive function alone and, in such cases, the front leg 3 may be eliminated. The backrest part 22 is confined to the position by the angle between the telescopic member 51 and the seat part 21, and rests against the rear leg 4. In this normal chair configuration, a weight lifting device 6 may be attached to the front end of the seat part 21 so that a user may sit on the chair and perform some foot exercises.

Figure 2:
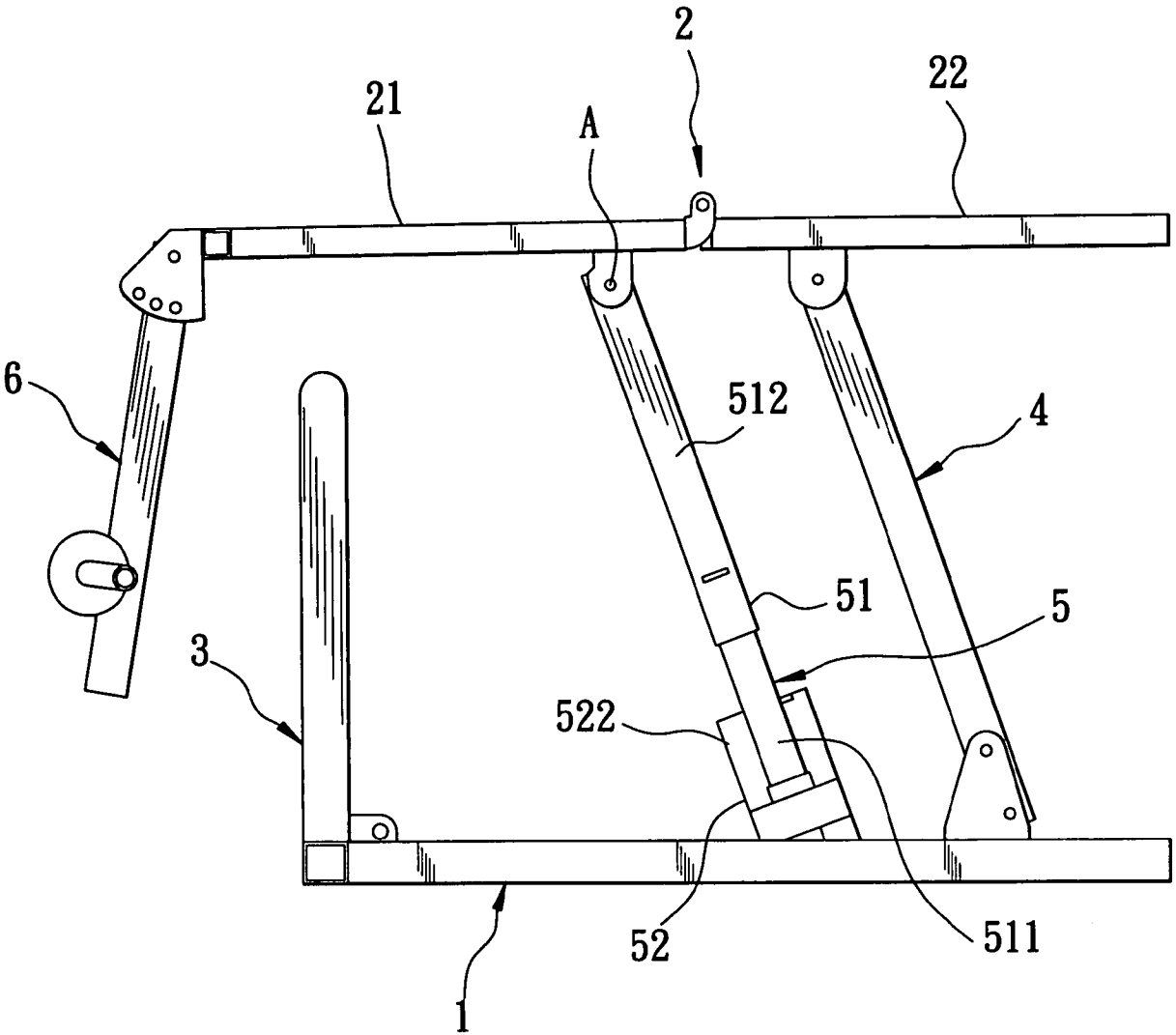
FIG. 2 is a side elevational view of the first preferred embodiment showing the seat part and the backrest part of the multifunctional chair in a substantially horizontal state.

To go to the second configuration of the multifunctional chair as shown in FIG. 2, in which the seat part 21 together with the backrest part 22 are placed in a substantially horizontal position, i.e., in the first raised position, the motor 522 is actuated to rotate the threaded rod 511 to extend from the outer cylinder 512 such that the outer cylinder 512 upwardly urges the seat part 21 to be displaced from the front leg 3. The angular position of the seat part 21 is consequently varied due to the pivotal rotation of the seat part 21 about the pivot connection "A". As the seat part 21 is raised, and the backrest part 22 and the rear leg 4 are moved so that the backrest part 22 falls back to a substantially horizontal position with the seat part 21. In this horizontal configuration, a flat surface is provided for a user to perform back stretching exercises or other suitable exercises.

Figure 3:
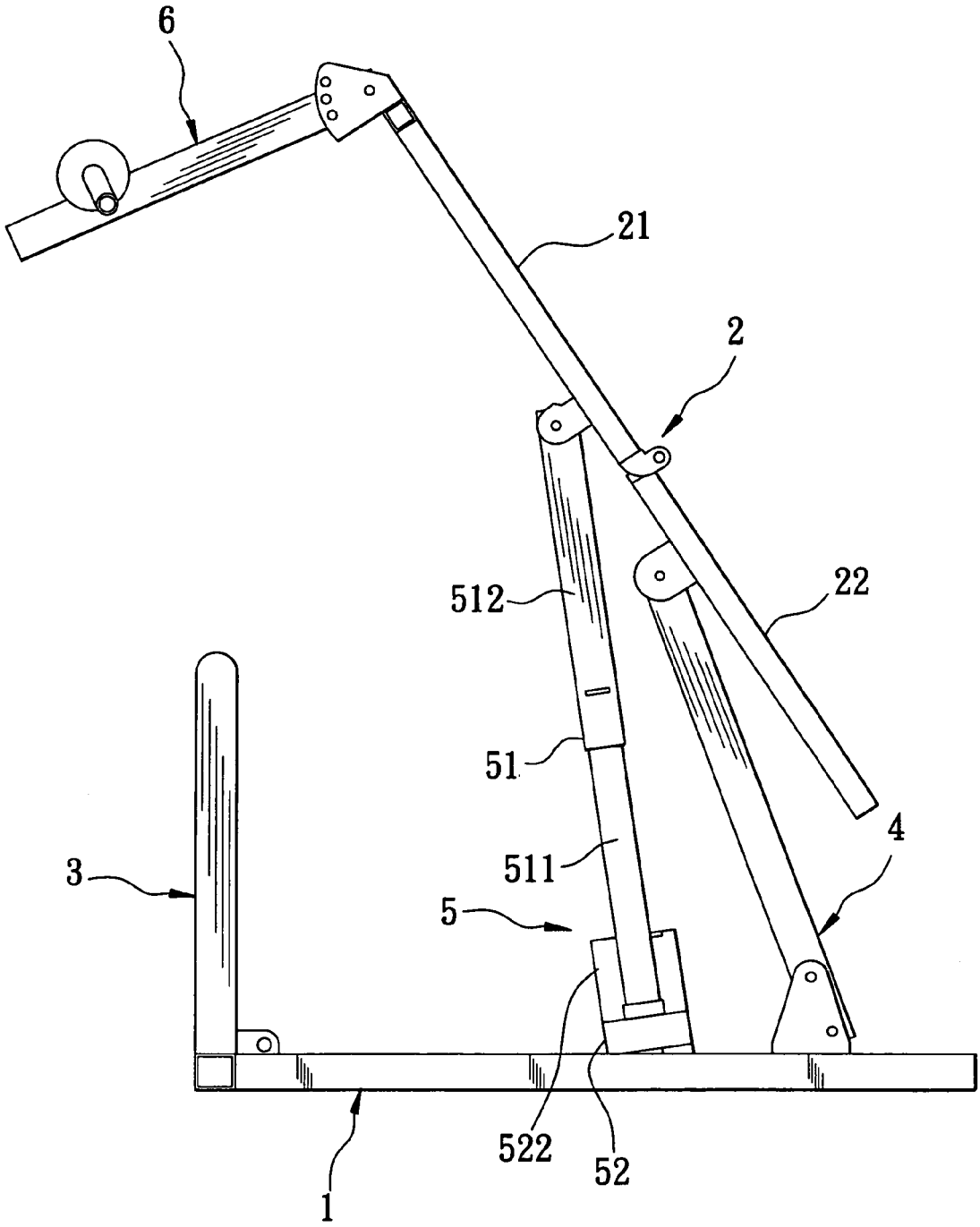
FIG. 3 is a side elevational view of the first preferred embodiment showing the seat part and the backrest part inclined in substantially the same inclining angle to provide the function of an inversion table.

To go to the third configuration of the multifunctional chair, i.e., from the first raised position to the second raised position shown in FIG. 3, the motor 522 is once again actuated so that the telescopic member 51 urges the seat part 21 upward further, and the seat part 21 turns about the pivot connection "A" and changes its angular position, so that the seat part 21 and backrest part 22 which are in the horizontal position are inclined at substantially the same inclining angle. In this inclined configuration of the multifunctional chair, the exercise function of an inversion table is provided.

Figure 4:
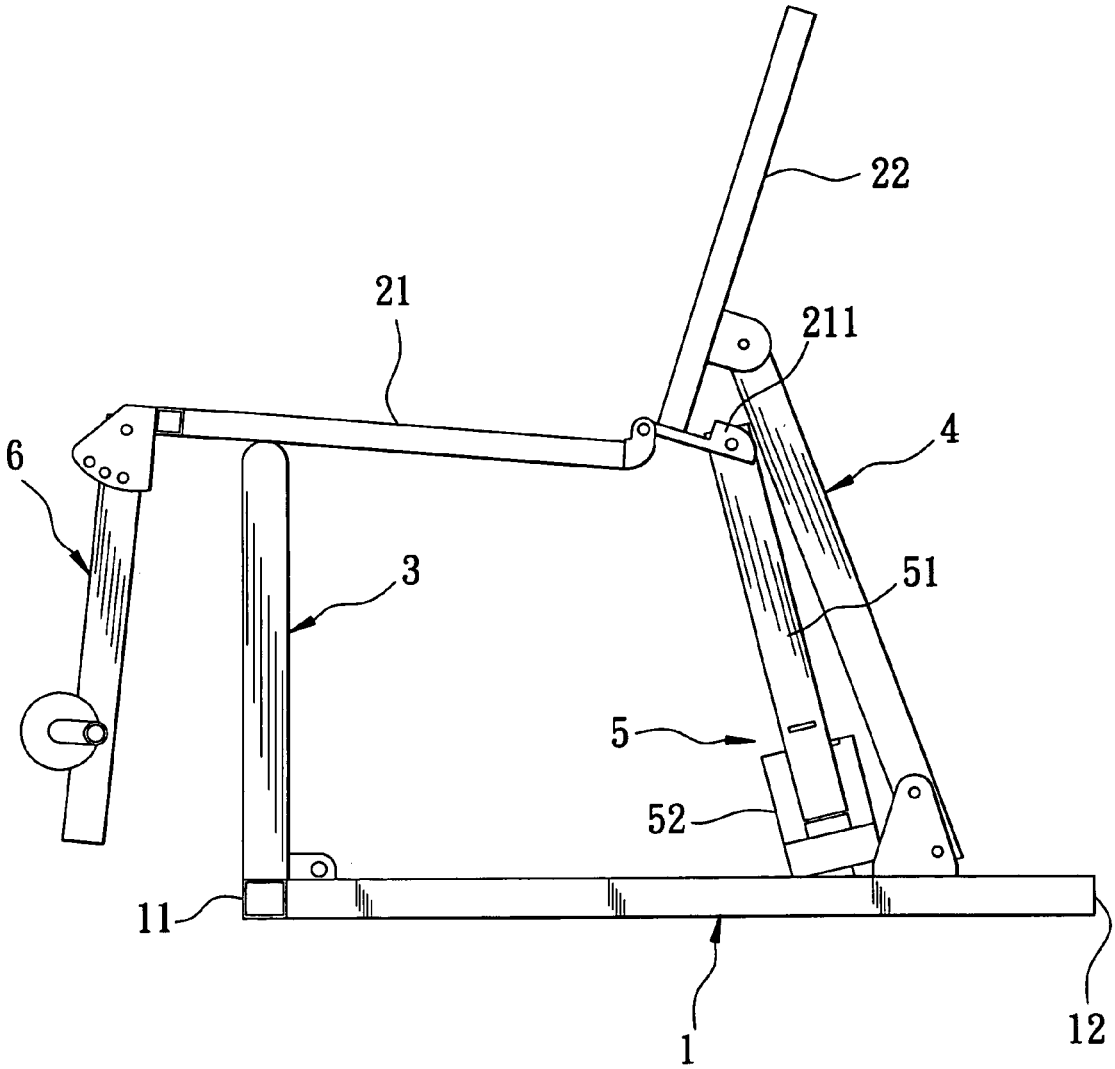
FIG. 4 is a side elevational view of a second preferred embodiment of the multifunctional chair according to the present invention.
Figure 5:
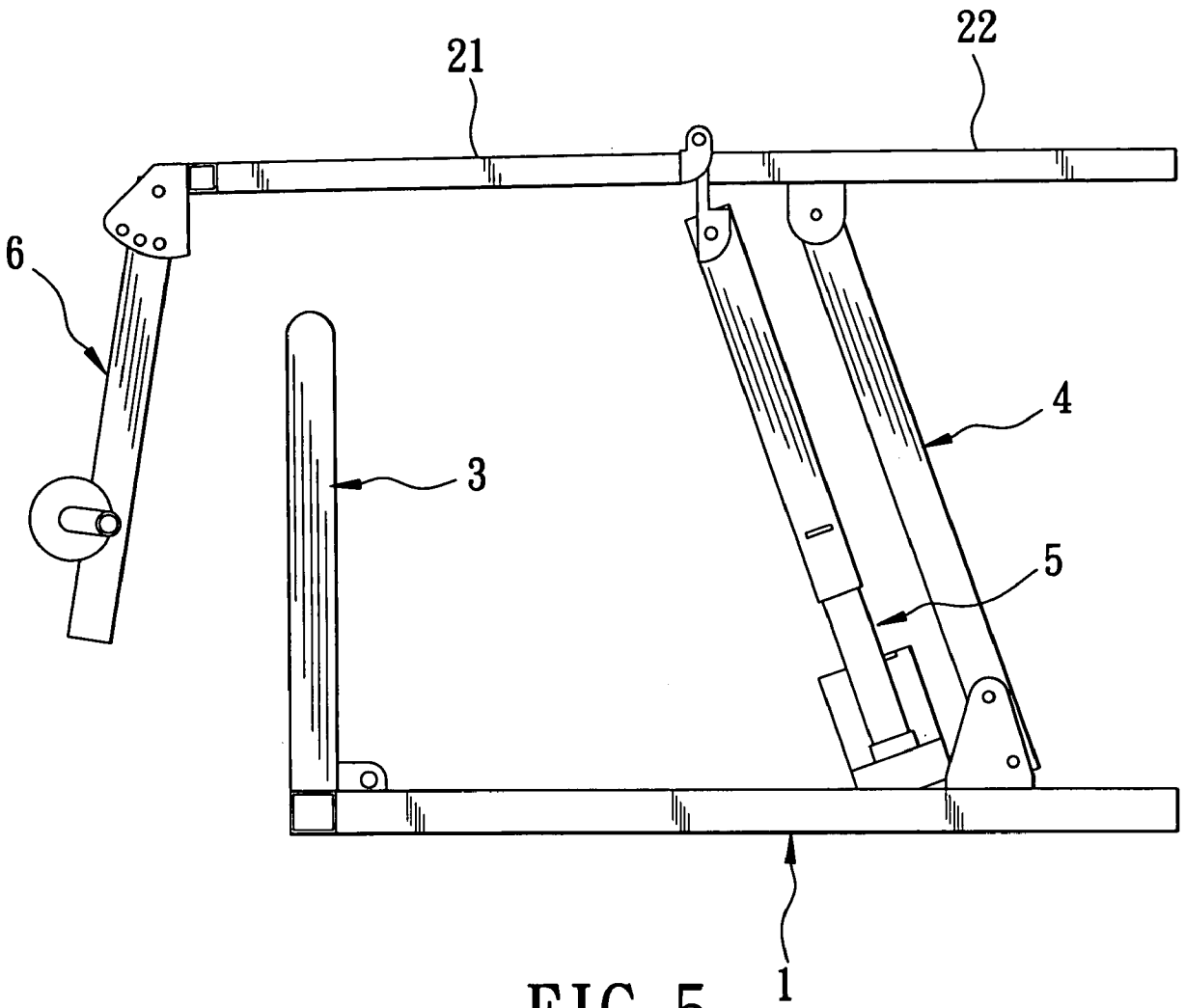
FIG. 5 is a side elevational view of the second preferred embodiment showing the seat part and the backrest part of the multifunctional chair in a substantially horizontal state.
Figure 6:
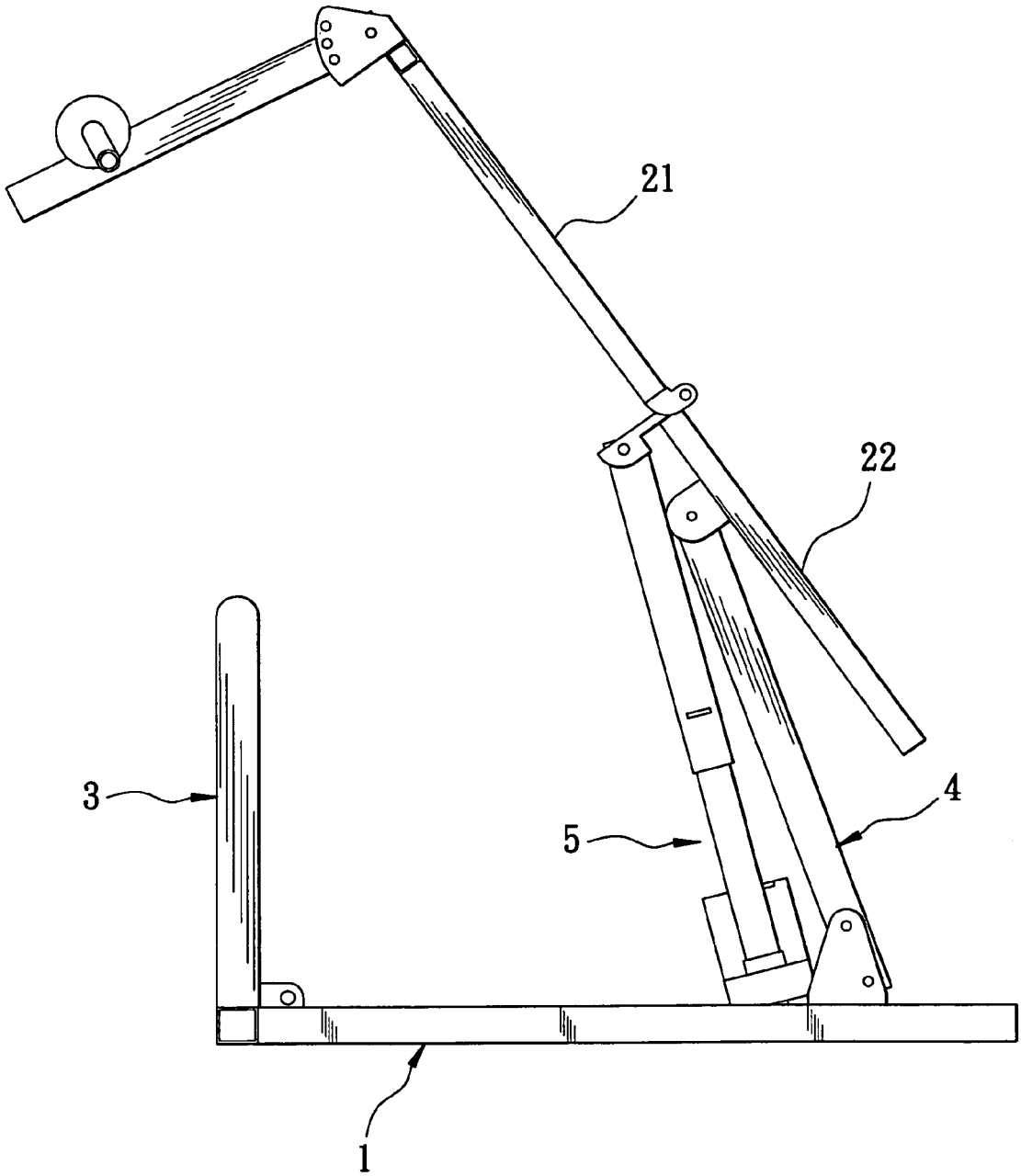
FIG. 6 is a side elevational view of the second preferred embodiment showing the seat part and the backrest part inclined in substantially the same inclining angle to provide the function of an inversion table.

With reference to FIGS. 4, 5 and 6, a second preferred embodiment of the multifunctional chair according to the present invention is shown. The second embodiment is substantially the same as the first embodiment, except in the following aspects:

The telescopic member 51 of the telescopic device 5 is pivotally attached to the rear end of the seat part 21 through a connection plate 211, and the drive means 52 is mounted adjacent the second end 12 of the base 1. As in the first preferred embodiment, the telescopic member 51 in the normal position provides a chair configuration as shown in FIG. 4, or the telescopic member 51 may be actuated by the drive means 52 to urge the seat part 21 upwardly to a first raised position where the seat part 21 and the backrest part 22 are placed in a substantially horizontal position, best shown in FIG. 5, or to urge the seat 21 further to a second raised position such that the horizontal seat part 21 and backrest part 22 are inclined at substantially the same inclining angle, best shown in FIG. 6.

Figure 7:
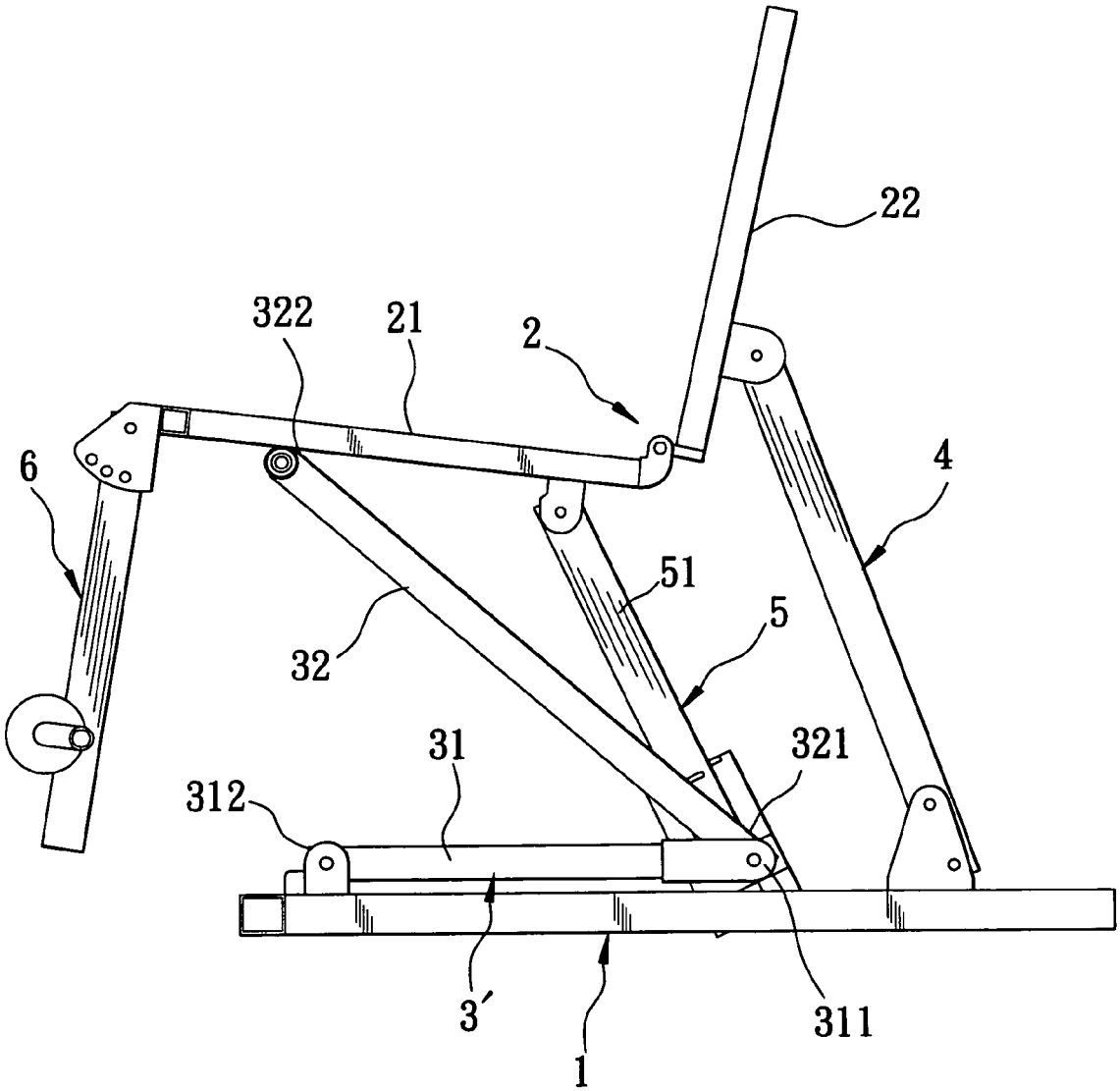
FIG. 7 is a side elevational view of a third preferred embodiment of the multifunctional chair according to the present invention.
Figure 8:
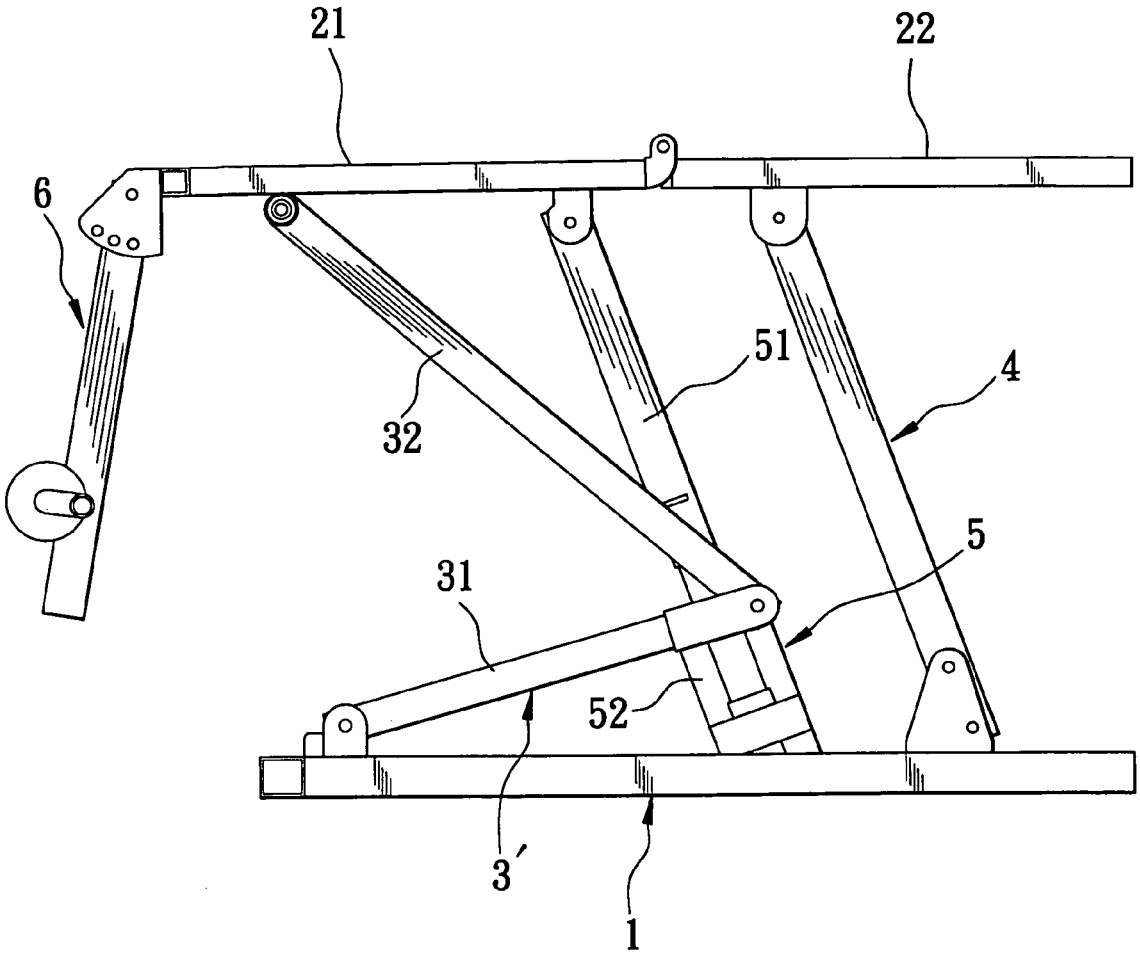
FIG. 8 is a side elevational view of the third preferred embodiment of showing the seat part and the backrest part of the multifunctional chair in a substantially horizontal state.
Figure 9:
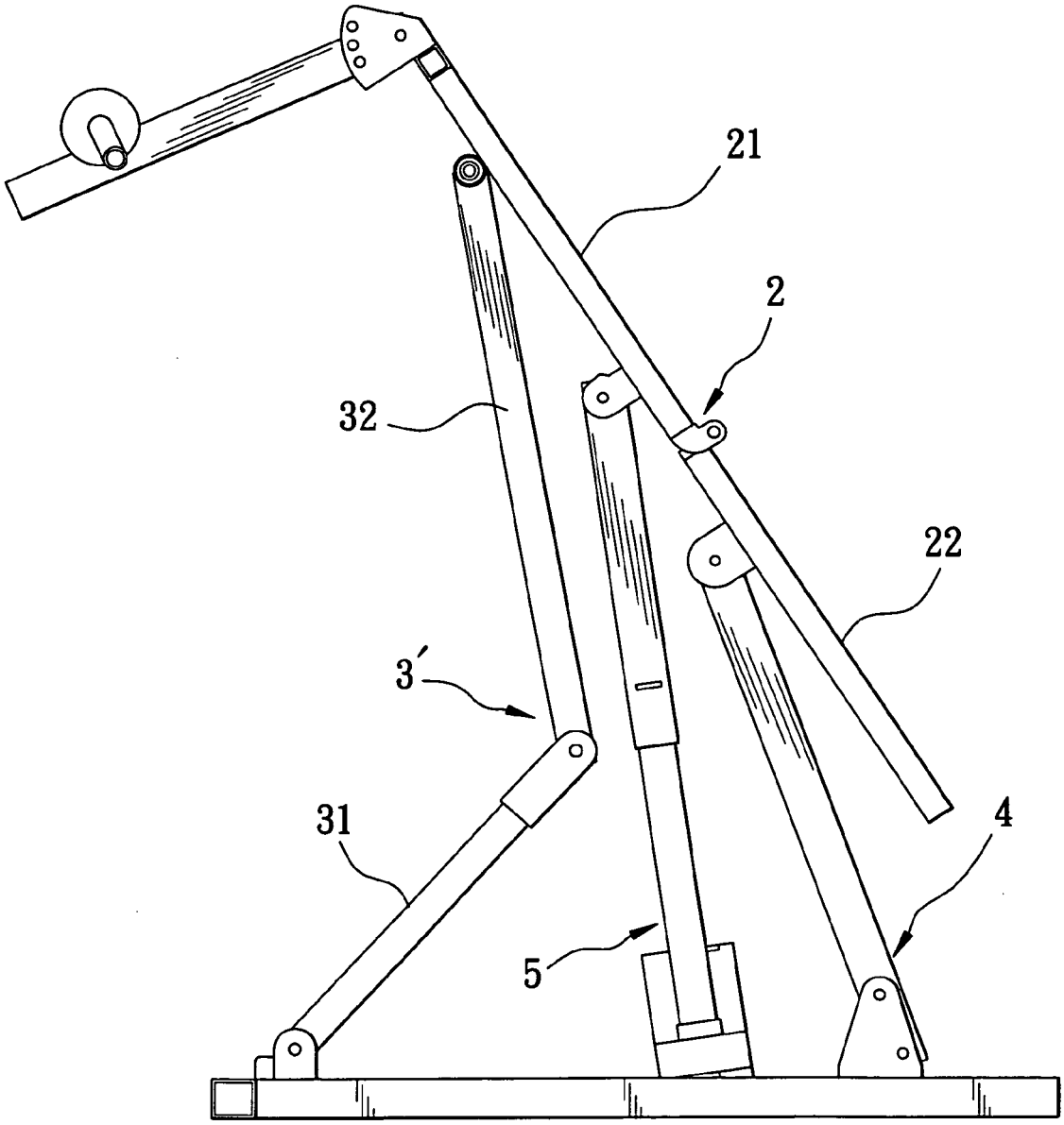
FIG. 9 is a side elevational view of the third preferred embodiment showing the seat part and the backrest part inclined in substantially the same inclining angle to provide the function of an inversion table.

With reference to FIGS. 7, 8 and 9, a third preferred embodiment of the multifunctional chair according to the present invention is shown. This third embodiment is substantially the same as the first embodiment, except in the following aspects:

The front leg 3' is composed of first and second portions 31,32 which are pivotally interconnected to one another. One end 312 of the first portion 31 opposite to the second portion 32 is pivotally connected to the base 1, while one end 322 of the second portion 32 opposite to the first portion 31 is pivotally attached to the seat part 21. The first and second portions 31,32 are inclined with respect to each other and the angle formed therebetween are varied as the seat part 21 is urged upward by the telescopic member 51 in the first and second raised positions. This construction of the front leg 3' provides a supporting effect to the seat part 21 in all three configurations of the multifunctional chair. In the same way as in the first embodiment, the telescopic member 51 in the normal position provides a chair configuration as shown in FIG. 7, or the telescopic member 51 may be actuated by the drive means 52 to urge the seat part 21 upwardly to a first raised position where the seat part 21 and the backrest part 22 are placed in a substantially horizontal position, as shown in FIG. 8, or to urge the seat 21 further to a second raised position such that the horizontal seat part 21 and backrest part 22 are inclined at substantially the same inclining angle, as shown in FIG. 9.

It can be appreciated, from the foregoing description, that the multifunctional chair of the present invention has the following advantages and effects:

The present invention integrates various functions into one structure. Thus, the present invention allows for extensive savings not only in terms of space but also in terms of expenses as it would not be necessary to have a number of exercise or fitness machines to be able to perform different exercises. It is worthwhile to mention that the present invention is fairly simple in terms of operation. It is only necessary to actuate the telescopic device 5 to achieve the object of changing the configuration of the multifunctional chair to provide a different function. This effectively elevates the utility and convenience of the multifunctional chair in terms of use.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A multifunctional chair comprising:

a base adapted to rest on the ground;

a support frame including a seat part and a backrest part pivotally attached to said seat part in the normal position of said chair;

a leg frame supporting said support frame and including a rear leg disposed between said backrest part and said base, said rear leg having a first end pivotally connected to said backrest part and a second end pivotally connected to said base; and a power-operated telescopic device disposed between said base and said support frame, said telescopic device including a telescopic member pivotally connected to said seat part, said telescopic member being operable to maintain said seat part at a level lower than said backrest in the normal position providing a chair function, or to move said seat part to a first raised position in which said seat part together with said backrest part are placed in a substantially horizontal position, or to a second raised position in which said seat part together with said backrest part are inclined at substantially the same inclining angle, wherein said leg frame further includes a front leg disposed between said seat part and said base and attached to said base.

2. The multifunctional chair of claim 1, wherein said telescopic member is disposed between said front leg and said rear leg.

3. The multifunctional chair of claim 1, wherein said telescopic member includes an internally threaded outer cylinder and an externally threaded rod inserted threadedly into said outer cylinder, and said telescopic device further includes drive means to rotate said rod to either retract or extend from said outer cylinder.

4. The multifunctional chair of claim 1, wherein said front leg supports said seat part in said normal position of said chair.

5. The multifunctional chair of claim 1, wherein said front leg includes a first portion and a second portion pivotally connected to said first portion, one end of said first portion opposite to said second portion being pivotally attached to said base, and one end of said second portion opposite to said first portion being pivotally attached to said seat part.

6. The multifunctional chair of claim 1, wherein said seat part has a rear end connected to said backrest part and a front end opposite to said rear end, and said telescopic number is pivotally connected to said seat part between said front and rear ends.

7. The multifunctional chair of claim 1, wherein said seat part has a rear end connected to said backrest part and a front end opposite to said rear end, and said telescopic member is pivotally connected to said rear end of said seat part.

8. The multifunctional chair of claim 1, wherein said seat part has a rear end connected to said backrest part and a front end opposite to said rear end, and said support frame further includes a weight lifting device attached to said front end of said seat part for providing foot exercise function when said seat part is placed in said normal position.

* * * * *